US005222428A

United States Patent [19]

Janetzko et al.

[11] Patent Number: 5,222,428

[45] Date of Patent: Jun. 29, 1993

[54] PISTON CYLINDER UNIT FOR PRESSURE FLUIDS

[75] Inventors: Horst Janetzko, Celle; Helmut Göttling, Isernhagen, both of Fed. Rep. of Germany

[73] Assignee: Mannesmann Aktiengesellschaft, Dusseldorf, Fed. Rep. of Germany

[21] Appl. No.: 837,028

[22] Filed: Feb. 14, 1992

[30] Foreign Application Priority Data

Feb. 15, 1991 [DE] Fed. Rep. of Germany ..... 4105124

[51] Int. Cl.[5] ..... F15B 15/26

[52] U.S. Cl. ..... 92/28; 92/137; 188/64; 188/74; 474/111; 474/140

[58] Field of Search ..... 188/64, 74; 474/111, 474/140; 92/27, 28, 20, 137

[56] References Cited

U.S. PATENT DOCUMENTS 2,089,202 8/1937 Gartin ..... 92/137

3,999,633 12/1976 Prouhet ..... 188/64

FOREIGN PATENT DOCUMENTS 3229305 2/1984 Fed. Rep. of Germany .

*Primary Examiner*—Thomas E. Denion

*Attorney, Agent, or Firm*—Cohen, Pontani, Lieberman, Pavane

[57] ABSTRACT

A piston-cylinder unit for pressure fluids includes a housing bounded by a head piece at each end thereof; a cylinder disposed within the housing; a piston reciprocatingly movable within the cylinder; a pulley having a circumferential outer surface is mounted for rotation about an axis within each of the head pieces; a pull belt is secured to the piston and looped around the outer surface of the pulleys; a power pick-up is attached to the pull belt; a braking device for the pull belt is disposed within the head piece and juxtaposed with at least one of the pulleys and has a shape which is complementary to at least a portion of the circumferential surface of the pulley; and a feed conduit connected to the head piece for feeding the pressure fluid to the braking device.

6 Claims, 3 Drawing Sheets

PISTON CYLINDER UNIT FOR PRESSURE FLUIDS

FIELD OF THE INVENTION

The present invention relates to a piston-cylinder unit for pressure fluids and, specifically, to a breaking device for a rod-less cylinder.

BACKGROUND AND SUMMARY OF THE INVENTION

Rod-less cylinders require a braking device as stopping means. Such a braking device generally requires additional measures to enlarge the outside dimensions of a standard cylinder. However, such a manner of construction, which leads to large outside dimensions, is undesirable for many applications.

An example of a rod-less cylinder is shown in German patent publication C2 32 29 305. In that device the power pick-up surrounds a cylinder housing and has a braking device within the inside thereof. The braking device consists of a pressure body with an angular brake lining which can be brought against a special brake path so that, upon actuating a pressure chamber which is disposed above the brake lining or the pressure body, the pressure body is pressed against the braking surface. At the same time, a support path is created on each one of the polygonal cross sections of the cylinder, and on which paths the power pick-up rests via rollers. Since the power pick-up always moves in conjunction with the piston, the feed line for the pressure fluid must also be constructed movable.

It is thus an object of the present invention to avoid the necessity of a special brake rail together with the respective brake lining and pressure body in addition to the carriage guide, but nevertheless provide an effective brake which, if at all, increases the dimensions of the unit only slightly, and, in addition, can be economically manufactured.

This and other objects are achieved in accordance with the present invention by providing a rod-less cylinder unit having a pull belt which is fastened to the end parts of the piston and is sealed off at each end of the cylinder. The piston-cylinder unit has guide pulleys for the pull-belt which are rotatably mounted on head pieces, a power pick-up fastened to the ends of the pull-belt which is movable parallel to the piston and a braking device for the piston which breaking device can be actuated by a pressure fluid. The braking device is associated with at least one of the pulleys, it is arranged within the head piece and is preferably adapted to the outer shape of the pulley and/or of the pull belt which is supported by the pulley. A feed line for the pressure fluid is connected to the stationary head piece of the unit. In this way one avoids having to arrange special brake rails over the length of the unit, which leads to a considerable increase of the structural height of the unit. It is further advantageous that the pressure fluid is no longer fed to the moving power pick-up but instead to the stationary head piece. Furthermore, the unit can be manufactured at considerably less expense.

The present invention can be constructed in accordance with the above-described basic concept by providing on the corresponding head piece of at least one pulley an intermediate piece on which a braking element is mounted facing the deflected section of the pull belt. The braking device or brake element is controllably actuated by the pressure fluid passing through a feed line in the head piece and through a channel in the wall of the brake element. This embodiment does not require more space than that required by the structural width of the unit determined by the pulley, and it utilizes the available unused space within the inside of the head piece. Preferably, the intermediate piece is rigidly attached to the head piece.

Another embodiment of the present invention provides that the brake element consists of a support section or profile which corresponds in shape to the circumferential path and the cross section of the pull belt. The brake element is surrounded by a tubular body which is closed at its ends. This results in an extremely efficient utilization of the available space and provides the largest possible braking surface.

The present invention further provides a channel for the pressure fluid disposed on the support section or support profile opposite the flexible pull belt. The pressure fluid channel which is open toward the tubular body extends transverse to the axis of rotation of the pulley and preferably, at least in part, around the deflected section of the pull belt. This substantial wrapping of the circumferential outer surface of the pulley leads to the desired largest possible braking surface.

Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

BRIEF DESCRIPTION OF THE DRAWINGS

One embodiment of the present invention is described below in further detail with reference to the accompanying drawings in which.

DETAILED DESCRIPTION OF THE PRESENTLY PREFERRED EMBODIMENT

Figure 1:
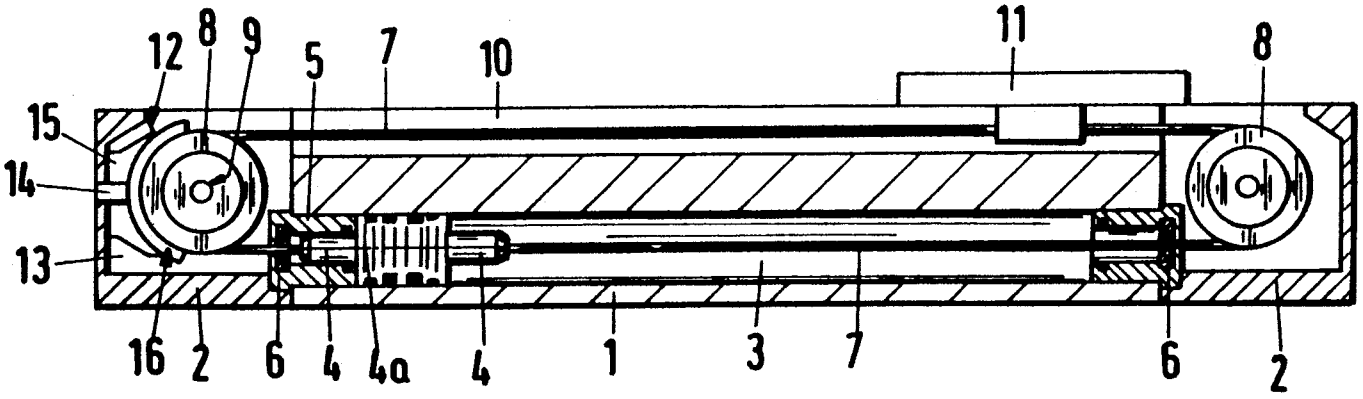
FIG. 1 is a longitudinal sectional view through a stationary piston-cylinder unit.

The piston-cylinder unit for use with pneumatic or hydraulic pressure fluids shown in FIG. 1 has a housing 1 with a head piece 2 located at each end thereof. The housing 1 contains a cylinder space 3 extending substantially parallel to the housing axis with dimensions substantially corresponding to the dimensions of the piston 4*b*. Within the cylinder space 3, a pull belt 7, which is fastened to the end parts 4 of the piston, extends along the axis 4*a* of the piston, and is guided through the corresponding cylinder end 5 which is sealed off by a seal 6. The pull belt 7 is guided by the pulleys 8 which are mounted by rotary bearings 9 to the corresponding head piece 2. A second space in the housing extends co-axially with the space 3 in the housing and is dimensioned to allow for free movement of the pull belt. The pull belt 7 is fastened to a power pick-up 11 which extends through a longitudinal channel 10 in the housing 1. Furthermore, a braking device 12 in the housing, which will be described in further detail below, is provided in the inside 13 of the head piece 2. The brake device 12 has an outer circular shape which is concentric with respect to the pulley 8 and the arc defined by pull belt 7. A feed line 14 for feeding the pressure fluid to the stationary head piece 2 of the unit is connected to the housing 1, i.e. preferably to the head piece 2.

Figure 2:
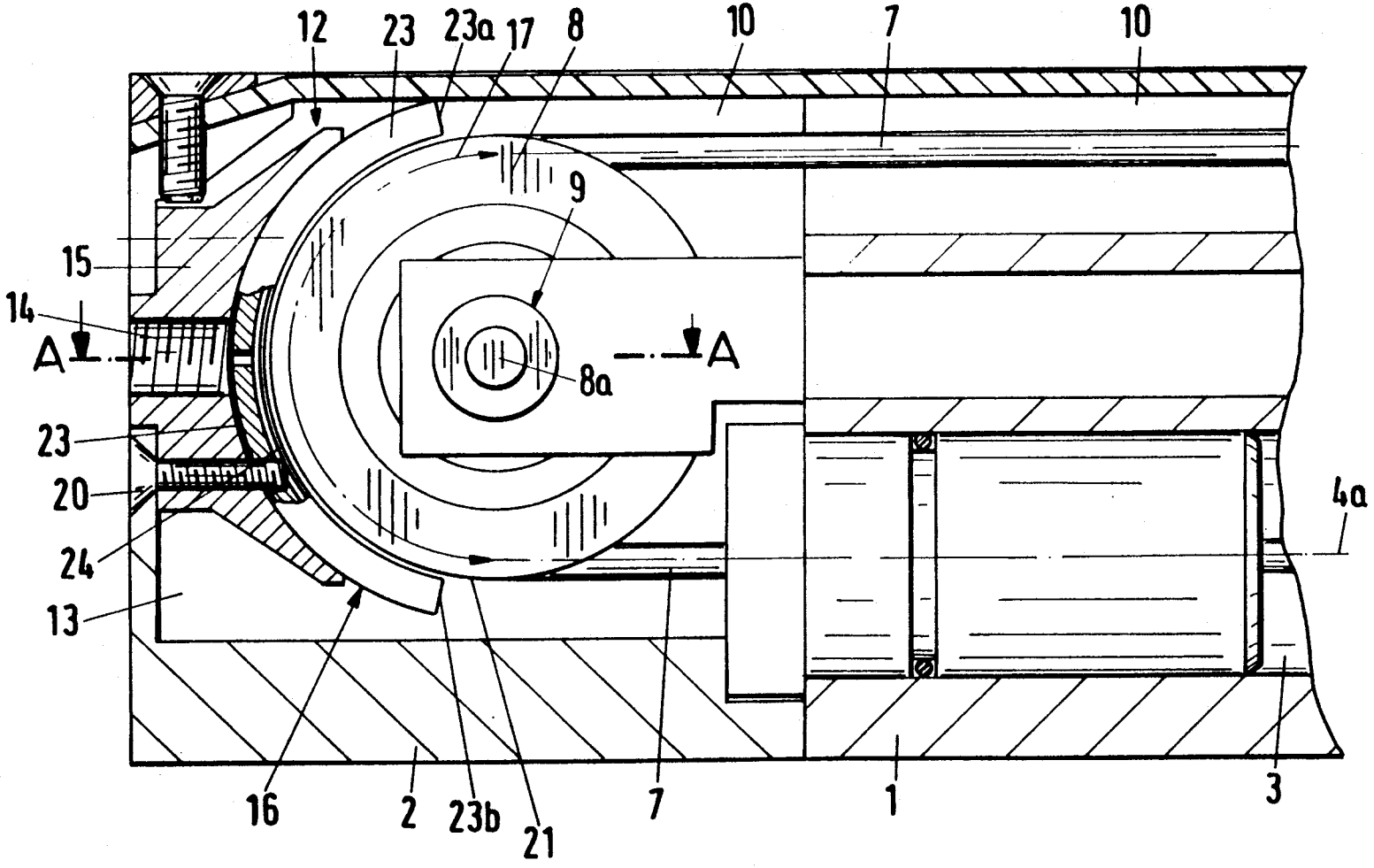
FIG. 2 is a partial longitudinal sectional view through the piston-cylinder unit in the region of the head piece.
Figure 3:
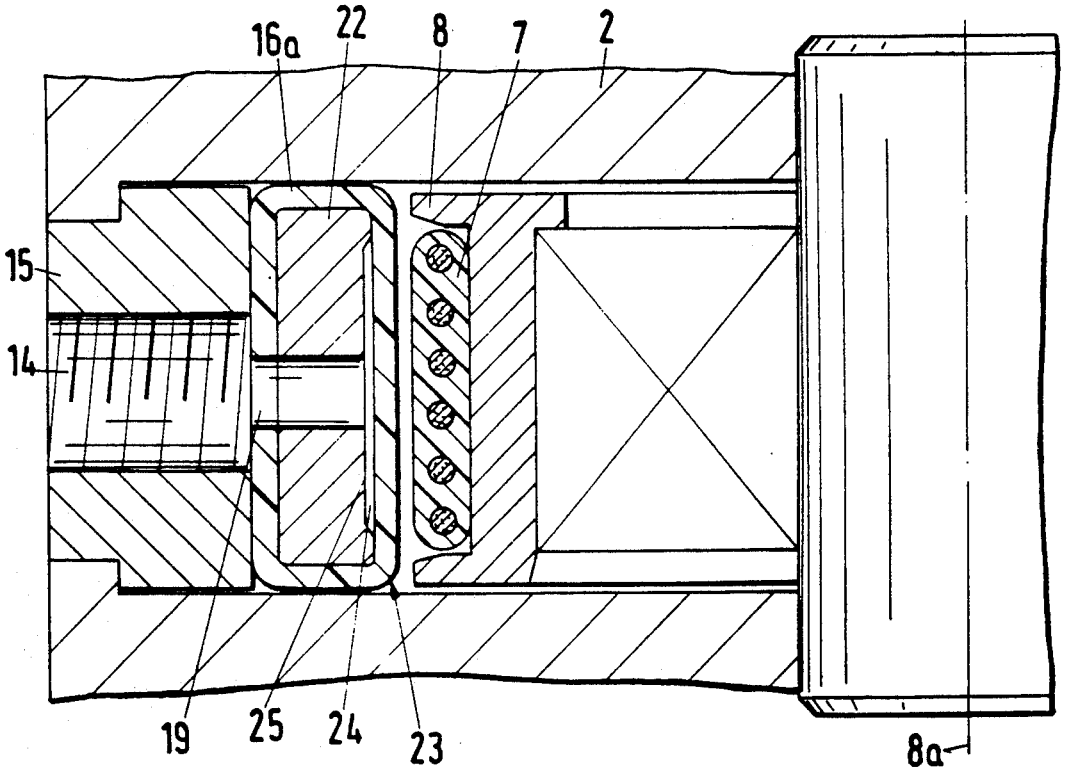
FIG. 3 is a horizontal partially sectional view along the line III—III of FIG. 2.

On the inside 13, between the end of the cylinder unit and the pulley 8, an intermediate piece 15 is mounted on the head piece 2 and bears a brake element 16. This brake element 16 which rests against the pulley 8 or against the pull belt 7 resting on the pulley 8, is engagable with the pulley or belt in accordance with the braking force. The size of the braking surface depends on the deflected section 17 of the pull belt 7 (FIG. 2). The braking force is produced in a controlled manner by a pneumatic or hydraulic pressure fluid which is fed through the feed line 14 through the head piece 2, and through a channel 19 leading into the wall 16*a* of the brake element 16 at a fixed location.

In the embodiment as shown, the intermediate piece 15 is firmly attached to the head piece 2 by screws 20. The brake element 16 includes a support section 22 which is adapted to the circumferential path 21 defined by the outer surface of the pulley or the pull belt, and, preferably, also by the, for instance, oval cross section of the pull belt 7. The support section 22 is surrounded by a tubular body 23 which is closed on its ends 23*a* and 23*b*.

A channel 24 for the pressure-fluid extending transverse to the axis of rotation 8*a* of the pulley 8 is provided on the support section 22, opposite the flexible pull belt 7. The pressure-fluid channel 24 is constructed in flat form and extends around the brake element 16 and along the deflected section 17 of the pull belt 7. The pressure-fluid channel 24 has an open surface 25 facing the tubular body 23 so that the pressure of the pressure medium acts on the entire inside of the tubular body 23.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, however, therefore, to be limited only as indicated by the scope of the claims appended hereto.

What is claimed is:

1. A piston-cylinder unit for pressure fluids, comprising:

a housing bounded by a head piece at each end thereof;

a cylinder disposed within said housing;

a piston reciprocatingly movable within said cylinder;

a pulley having a circumferential outer surface and being mounted for rotation about an axis within each of said head pieces;

a pull belt secured to said piston and looped around said outer surface of said pulleys;

a power pick-up attached to said pull belt;

means for braking said pull belt disposed within at least one of said head pieces and juxtaposed with said pulley and comprising a support section having a shape which is complementary to at least a portion of said circumferential outer surface of said pulley and a tubular body having closed ends surrounding said support section; and means connected to said head piece for feeding a pressure medium into said tubular body for engaging the tubular body with said outer surface of said pulley.

2. The piston-cylinder unit of claim 1, additionally comprising an intermediate piece (15) mounted on said at least one of said head pieces, and wherein said tubular body comprises a wall (16*a*) and said support section is mounted on said intermediate piece facing said circumferential outer surface of said pulley; and said feeding means comprising a feed line extending through said head piece, and a channel disposed within said wall (16*a*).

3. The piston-cylinder unit of claim 2, wherein said intermediate piece (15) is secured to said at least one of said head pieces (2) against relative movement.

4. The piston-cylinder unit of claim 1, wherein said pulleys have a width and the shape of the support section is complementary to said width of said pulleys.

5. The piston-cylinder unit of claim 1, wherein said pressure medium feeding means comprises a pressure medium channel (24) within said support section (22) opposite said pull belt (7), said pressure medium channel facing said tubular body (23) and extending transverse to said axis of rotation of said pulleys (8) and along at least a part of said circumferential outer surface thereof.

6. The piston-cylinder unit of claim 2, wherein said channel is a pressure medium channel extending transverse to said axis of rotation of said pulleys (8) and along at least a part of said circumferential outer surface thereof.

* * * * *